United States Patent [19]

Lukehart

[11] Patent Number: 4,790,227

[45] Date of Patent: Dec. 13, 1988

[54] PICKS FOR STRINGED INSTRUMENTS

[76] Inventor: Donald W. Lukehart, Rock Bluff Rd., R.R. 4, Ottumwa, Iowa 52501

[21] Appl. No.: 70,306

[22] Filed: Jul. 6, 1987

[51] Int. Cl.[4] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 768,241 | 8/1904 | Seidel | 84/322 |
| 1,184,561 | 5/1916 | Napoletano | 84/322 |
| 1,263,740 | 4/1918 | Burdwise | 84/322 |
| 3,304,826 | 2/1967 | Caron | 84/322 |
| 4,248,128 | 2/1981 | Des Gaines | 84/322 |
| 4,398,444 | 8/1983 | Walker | 84/322 |

*Primary Examiner*—Lawrence R. Franklin

*Attorney, Agent, or Firm*—Kenneth T. Theodore

[57] ABSTRACT

The invention is an improvement in picks for stringed instruments whereby the pick has multiple edges which displace the string of the instrument by multiple impacts for each stroke thereof. The multiple impacts result in a revibration of the string which increases the harmonic content of the produced sound and creates a sound which is unique and different from that of a standard pick. The sound has a higher treble, is clearer with higher overtones, and provides a higher pitch than picks of the prior art. The pick consists of a center element central between two outer elements with the center element slightly longer than the outer elements, thereby giving the pick multiple edges. This arrangement permits the pick to be equally functional in both the upstroke and the downstroke.

7 Claims, 1 Drawing Sheet

PICKS FOR STRINGED INSTRUMENTS

BACKGROUND OF THE INVENTION

1. Field of the Invention

This invention lies within the field of musical instruments, specifically stringed instruments.

2. Description of the Prior Art

There is no known prior art which produces multiple and separate displacements of a string by the single stroke of a pick. Additionally, the prior art is void of any reference which produces the additional harmonic content from a single stroke of a pick upon an individual string.

SUMMARY AND OBJECTS OF THE INVENTION

The invention is a novel and unique pick which produces multiple harmonic nodes from the single stroke upon an individual string. It has a bar shaped center portion with a picking tip on one end and four segments at the opposite end. Said segments are perpendicular to the axis of said portion and are affixed thereto in complimentary pairs, two on each side of said portion. A user utilizes the segments for both holding the pick by the fingers and for placing the center portion at the preferred attitude for 'picking' the instrument.

The outermost end of the center portion has multiple and symmetrical tiered edges. Said edges sequentially displace an instrument's string(s) to correspondingly produce the revibration and the additional harmonic content of the sounds.

It is the primary object of the invention to provide a pick for stringed instruments which produces the revibration from a single stroke of the pick upon a string.

It is an object of the invention to provide a pick which accomplishes the above in both the upstroke and the downstroke pick movement.

DESCRIPTION OF THE PREFERRED EMBODIMENT

While the preferred embodiment is illustrated and described below, it is to be understood that variations will be apparent to those skilled in the art without departing from the principles of the invention. Accordingly, the invention is not to be limited to the specific form as described and illustrated but rather is to be limited only by a literal interpretation of the claims appended herein.

Figure 1:
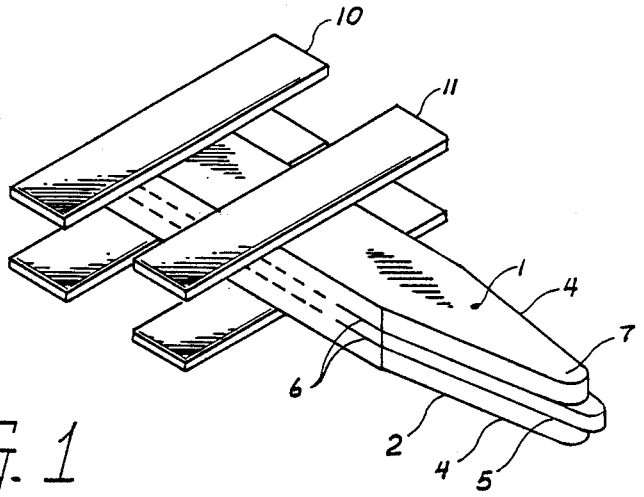
FIG. 1 is a perspective view of the Invention.

The improved pick 1, as illustrated in FIG. 1, is of a non-standard configuration having a rectangular bar shaped center portion 2 which is attached to and extends radially outward from multiple segments 10,11 which are penpendicular to the axis of said portion 2. As will be taught below, said pick 1 is grasped by a user by placing said segments 10,11 between his thumb and fingers such that said center portion 2 extends radially outward therefrom in an attitude proper for striking a musical string.

Said center portion 2 consists of three elements, i.e., two identical outer elements 4, and a thinner but similarly shaped center element 5 positioned between and cooperating with said outer elements 4. Said elements 4,5 are laminated together over a portion of their total length, beginning with the end nearest said segments 10,11. For teaching purposes, said lamination means is illustrated as broken lines 6 in FIG. 1. The lamination provides said center portion 2 with a solid structural embodiment having the requisite strength and minimum flexibility to withstand the stress and strain experienced by such picks.

Starting approximately at the end of said laminations 6, the sides of said elements 4,5 converge toward each other in a symmetrically triangular manner and terminate at a rounded end, thereby forming a picking tip 7 of said invention. It is this unlaminated tip 7 which impacts the string initially in either the up or down stroke. The flexibility of said tip 7 is altered to the preference of the user by use of different materials and the various thicknesses of said elements 4,5.

Figure 2:
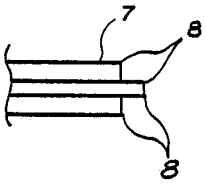
FIG. 2 is a side view of the center portion to illustrate the symmetrical tiered edges.

Said center element 5 protrudes approximately a fraction of an inch beyond said outer elements 4, forming tiered edges 8 which are symmetrical about the center portion 2, as illustrated by FIG. 2. It is these tiered edges 8 which present the most novel and unique feature of the invention, that of producing revibration and multiple harmonic nodes from a single stroke upon a musical string.

Figure 3A:
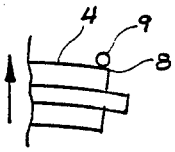
FIGS. 3*a* and 3*b* is a sequential illustration of how the tiered edges displace the instrument's string sequentially.

FIGS. 3*a,b* graphically illustrates how said edges 8 produce multiple impacts as taught below. In FIG. 3*a*, a musical instrument's string 9 is illustrated in cross section and just touching the edge 8 on an outer element 4, as the pick 1 traverses upwardly. As with any pick of the prior art, said tip 7 and center portion 2 flexes downwardly due to the resistance of said string 9, as said string 9 is simultaneously displaced upwardly and to the right. This cooperating displacement/flexture continues until said string 9 is 'released' from the edge 8. This 'release' is typical of the prior art but for the invention, "is not a true 'release' in that the string 9 does not fall free of any constraints but falls only to said center element 5 and " this is only the initial displacement of said string 9.

"At this instance, the string 9 is 'released' only to the extent of the kinetic energy which was stored within the single said outer element 4."

Figure 3B:
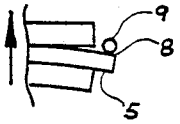

FIG. 3*b* illustrates that said pick 1 is still in a continuous upward traversement and said string 9, instead of vibrating free of said tip 7, impacts upon the tiered edge 8 of said center element 5. It again is displaced upwardly and to the right until it again is released from the tiered edge 8.

"This second release allows the string 9 to fall totally free to set up a revibration within the string 9, complimenting that which was initially established above. This second release also was accomplished by imparting the combined kinetic energy of both the center element 5 and the remaining outer element 4. This enables the string 9 to have a second tone quality which is distinguishably different from that obtained from the first 'release'."

The initial displacement of the string 9 produces the characteristic sound of the instrument; whereas, the second impact from center element 5 shifts the phase of the characteristic sound (that which makes the instrument unique) resulting in total revibration. The complex displacement is resolved into simple harmonic motion greatly enhancing the characteristic sound of the instrument. This is taught herein as the phase shift and revibration of the string 9. The said phase shift is clearly due to the time between said string 9 release from the outer element 4 and subsequent release from the inner element 5.

The time of said phase shift is obviously dependent upon the speed of said pick 1, but is also controllable by both the thickness of said outer element 4 and flexibility of both said elements 4,5. These variables can be utilized in the manufacturing process to produce picks 1 customized for individual users and/or the type of music to be played, and/or for the form of instrument used.

FIG. 3 also illustrates that said pick's symmetrical tiered edges 8 are equally effective on the pick's downstroke as well as the upstroke.

A pair of complimentary upper segments 10, one on each side of said portion 2 at the end thereof opposite said tip 7, are affixed perpendicular to the axis of said portion 2. A pair of complimentary lower segments 11, approximately at the center of said portion 2, are similarly placed. Said segments 10,11 are permanently attached to said portion 2. The segments 10,11 are utilized by a user for securely gripping the pick 1 between the thumb and forefinger such that the center portion 2 projects outwardly from said thumb at an attitude approximately perpendicular therefrom. This is accomplished by the user placing his thumb between two such elements 10,11 with the side of the forefinger lying angularly across the opposite elements 10,11. The grip above provides a very secure grip which is much less fatiguing than prior art and equally useable in both the upstroke and downstroke play.

Said pick 1 can be manufactured of any materials which have the requisite strength and flexibility. Typical materials would be plastics, fiberglass, ivory and any combinations thereof, dependent only on the user requirements. Said lamination means and attachment of said elements 10,11 can be accomplished by adhesives, mechanical fasteners and welding. For teaching purposes, the Figures illustrate only adhesive means.

Having fully described my invention, what I claim is;

1. A pick for a stringed musical instrument, comprising:

three planar elements, each having a predetermined flexibility;

said planar elements being oriented parallel to one another and having at least one surface in contact with at least one of the other planar elements;

said planar elements being secured together over a selected portion of said contact surface to form a body portion of the pick adapted to be held by the thumb and forefinger of a user, the remaining portion of the planar elements forming picking tips;

the picking tips of the top and bottom elements having a predetermined length and the picking tip of the middle element having a slightly longer length than said predetermined length; and gripping means fixed to said body portion.

2. A pick as in claim 1 wherein said planar elements are secured by a lamination process.

3. A pick as in claim 2 wherein said planar elements are secured over at least half of said contact surface.

4. A pick as in claim 1 wherein said gripping means consists of a pair of upper segments and a pair of lower segments fixed to the upper portion and the lower portion of said body portion, respectively, one segment of each of said pairs being fixed to opposite sides of said body portion.

5. A pick as in claim 4 wherein each of said segments is substantially rectangular in shape and positioned on said body portion approximately perpendicular to the axis of symmetry of said picking tips.

6. A pick as in claim 1 wherein said picking tips have edges which are tapered, converging from said body portion to rounded tips.

7. A pick as in claim 6 wherein the edges of said planar elements forming said body portion and the edges of said picking tips are flush with the exception of said rounded tips.

* * * * *